US005932962A

United States Patent [19]

Nakatani et al.

[11] Patent Number: 5,932,962

[45] Date of Patent: Aug. 3, 1999

[54] ELECTRON EMITTER ELEMENTS, THEIR USE AND FABRICATION PROCESSES THEREFOR

[75] Inventors: Tadashi Nakatani; Keiichi Betsui; Shinya Fukuta, all of Kanagawa, Japan

[73] Assignee: Fujitsu Limited, Kawasaki, Japan

[21] Appl. No.: 08/654,428

[22] Filed: May 28, 1996

[30] Foreign Application Priority Data

Oct. 9, 1995 [JP] Japan ..... 7-261793

[51] Int. Cl.[6] ..... H01J 19/24

[52] U.S. Cl. ..... 313/495; 313/497; 313/308; 313/309; 313/336; 313/351

[58] Field of Search ..... 313/495, 496, 313/497, 306, 308, 309, 336, 351

[56] References Cited

U.S. PATENT DOCUMENTS 5,235,244 8/1993 Spindt ..... 313/309 X
5,534,744 7/1996 Leroux et al. ..... 313/309
5,543,691 8/1996 Palevsky et al. ..... 313/309 X
5,548,185 8/1996 Kumar et al. ..... 313/497 X
5,587,720 12/1996 Fukuta et al. ..... 313/309 X

*Primary Examiner*—Ashok Patel
*Attorney, Agent, or Firm*—Nikaido, Marmelstein, Murray & Oram LLP

[57] ABSTRACT

An electron emitter element is provided which comprises: an insulating base having a gate opening and a slit communicating to the gate opening; an emitter electrode layer formed in the gate opening and the slit on the insulating base; an emitter tip formed in the gate opening on the emitter electrode layer; a gate electrode layer formed on a top surface of the insulating base as circumscribing the gate opening and extending perpendicular to the emitter electrode layer; and the gate electrode layer and the emitter electrode layer being crossed each other with nothing interposed therebetween.

13 Claims, 16 Drawing Sheets

ELECTRON EMITTER ELEMENTS, THEIR USE AND FABRICATION PROCESSES THEREFOR

BACKGROUND OF THE INVENTION

1. Field of the Invention

The present invention relates to an electron emitter elements, their use and fabrication processes therefor. More particularly, the invention relates to an electron emitter elements, their use and a fabrication processes therefor which ensure excellent display characteristics (high brightness, high resolution, high response time, low power consumption and wide view angle). The electron emitter element of the present invention is a promising electron source for a thin panel display device in wide application fields such as of portable terminals and wall-type TVs.

2. Description of Related Arts

Electron emitter elements are capable of extracting electrons from emitter tips on an emitter electrode by applying a voltage between the emitter tips and a gate electrode for electron extraction. The emitter tips are formed on the emitter electrode by way of semiconductor microprocessing techniques. The micron-order size of the emitter tips permits highly dense integration of the electron emitter elements.

FIG. 17 and FIG. 17*a* show one exemplary construction of a thin flat panel display device employing electron emitter elements. The display device includes a cathode plate and an anode plate facing opposite to each other across a vacuum space. Pixels each comprising a plurality of electron emitter elements are arranged in a matrix on the cathode plate. Emitter electrode lines (layers) 103 of the respective electron emitter elements intersect gate electrode lines (layers) 110 on an insulating (glass) substrate 101. An insulating film 104 is interposed between the emitter electrode lines 103 and the gate electrode lines 110. Several hundred to several thousand gate openings are formed in each of the intersection areas of the electrode lines 103 and 110, and emitter tips 108 are formed within the respective gate openings in contact with a corresponding emitter electrode line to define each pixel 111. Since the electron emission characteristics of the emitter tips 108 are nonlinear, the emitter tips 108 can be individually driven by selectively actuating the emitter electrode lines 103 and the gate electrode lines 110. Electrons extracted from emitter tips in a selected pixel 110 on the cathode plate 112 reach the anode plate 114 applied with a fluorescent substance 113 so that the fluorescent substance 113 is excited to emit light, which is used for display.

FIGS. 18(*a*) to 18(*h*) are schematic diagrams illustrating the respective steps of a conventional process for fms illustrating the respective steps of a conventional process for fabricating electron emitter array by vacuum evaporation. An emitter electrode material 102 is deposited on an insulating substrate 101 to form a plain film (see FIG. 18(*a*)). The plan film of the emitter electrode material 102 is patterned to form striped emitter electrode lines 103 (see FIG. 18(*b*)). Thereafter, an insulating film 104 is formed on the insulating substrate 101, and then a gate electrode made material 105 is deposited thereon (see FIG. 18(*c*)). In turn, the insulating film 104 and the gate electrode material 105 are etched to form a plurality of cylindrical gate openings 106. Thus, parts of emitter electrode are exposed in the gate openings 106 (see FIG. 18(*d*)). Then, aluminum or a like material is obliquely deposited on the resulting insulating substrate 101 to form a sacrificial film 107 in such a manner that the material is not deposited on the bottom of the gate openings 106 (see FIG. 18(*e*)). Further, an emitter tip material 108 such as molybdenum is vertically deposited on the resulting insulating substrate 101. As the emitter tip material 108 is deposited on the emitter electrodes, the gate openings 106 are gradually covered with the emitter tip material 108. When the gate openings 106 are completely covered, conical emitter tips 109 are formed on the emitter electrodes within the gate openings 106 (see FIG. 18(*f*)). In turn, the emitter tip material 108 deposited in a region other than around the gate openings 106 is removed by etching to expose the sacrificial film 107 (see FIG. 18(*g*)). Then, the resulting insulating substrate 101 is dipped in an aqueous solution of phosphoric acid for dissolution of the sacrificial film 107, so that the remaining emitter tip material 108 around the gate openings 106 is lifted off and the emitter tips 109 are exposed in the gate openings 106. Finally, a gate electrode material 105 is deposited on the resulting insulating substrate 101, and then patterned to form striped gate electrode lines 110 which extend perpendicular to the emitter electrode lines. Thus, an electron emitter array of a matrix structure is provided which is formed with emitter tips in intersection areas of the emitter electrode lines and the gate electrode lines (see FIG. 18(*h*)).

Thus, the formation of the plurality of electron emitter elements on the single substrate requires a plurality of process steps and inevitably entails dust contamination, which results in a defect. Particularly, when a defect occurs due to a short circuit between an emitter electrode line and a gate electrode line in one electron emitter element, it becomes impossible to apply a voltage to electron emitter elements connected to the same electrode lines as connected to the defective electron emitter element so that these electrode lines become defective. Further, the electron emission characteristics are sensitive to the surface conditions of the emitter tips. Therefore, the electron emission characteristics are more influenced by the dust contamination with the increase in the number of process steps, resulting in a reduced yield. In addition, a greater number of process steps increases the production cost.

Furthermore, when a pin hole is produced in the insulating film interposed between the emitter electrode lines and the gate electrode lines in crossover portions therebetween, the pin hole causes a short circuit between the gate electrode lines and the emitter electrode lines to interfere with the operation of the electron emitter array.

SUMMARY OF THE INVENTION

As a result of an intensive study in view of the foregoing, the inventors have achieved the present invention which provides: an electron emitter element and an electron emitter array which are free from a short circuit between an emitter electrode layer and a gate electrode layer due to a pin-hole defect in an insulating film and can be fabricated with a reduced process steps in comparison with a conventional fabrication process; a cathode plate using the electron emitter array; and a flat panel display device using the cathode plate.

In accordance with a first aspect of the present invention, there is provided an electron emitter element comprising: an insulating base having a gate opening and a slit communicating to the gate opening; an emitter electrode layer formed in the gate opening and the slit on the insulating base; an emitter tip formed in the gate opening on the emitter electrode layer; a gate electrode layer formed on a top surface of the insulating base as circumscribing the gate opening and extending perpendicular to the emitter electrode layer; and the gate electrode layer and the emitter electrode layer being crossed each other with nothing interposed therebetween.

In accordance with a second aspect of the present invention, there is provided an electron emitter array comprising: a plurality of electron emitter elements of the aforesaid construction; wherein the emitter electrode layers of the respective electron emitter elements are connected to each other, and the gate electrode layers of the respective electron emitter elements are connected to each other.

In accordance with a third aspect of the present invention, there is provided an electron emitter array comprising: a plurality of electron emitter elements arranged in an array and each including an insulating base having a gate opening, an emitter electrode layer formed in the gate opening on the insulating base, an emitter tip formed in the gate opening on the emitter electrode layer, and a gate electrode layer formed on a top surface of the insulating base as circumscribing the gate opening and extending perpendicular to the emitter electrode layer, the gate electrode layer and the emitter electrode layer crossing each other with nothing interposed therebetween; the gate opening being circular and having a diameter greater than a distance between centers of gate openings of adjacent electron emitter elements.

In accordance with a fourth aspect of the present invention, there is provided a cathode plate comprising a plurality of the electron emitter arrays of the aforesaid construction arranged in a matrix and each serving as a pixel.

In accordance with a fifth aspect of the present invention, there is provided a flat panel display device comprising: a cathode plate of the aforesaid construction; and an anode plate disposed facing opposite the cathode plate and having an electrode coated with a fluorescent substance which receives an electron emitted from an emitter tip to illuminate.

In accordance with a sixth aspect of the present invention, there is provided a process for fabricating an electron emitter element, comprising the steps of: etching a surface portion of an insulating base to form a gate opening and a slit communicating to the gate opening; depositing a conductive material on the entire surface of the resulting base under such conditions that the slit is covered therewith but the gate opening is not completely covered therewith to form a conductive film on a top surface of the insulating base and to form an emitter electrode layer in the gate opening and the slit on the insulating base; depositing a sacrificial film material on the entire surface of the resulting base under such conditions that neither the gate opening nor the emitter electrode layer formed in the gate opening is covered therewith to form a sacrificial film on the conductive film; depositing an emitter tip material on the entire surface of the resulting base under such conditions that the gate opening is completely covered therewith to form an emitter tip on the emitter electrode layer; removing the sacrificial film and the emitter tip material deposited on the sacrificial film; and etching the conductive film formed on the top surface of the insulating base into a desired configuration to form a gate electrode layer.

In accordance with a seventh aspect of the present invention, there is provided a process for fabricating an electron emitter array, comprising the steps of: etching a surface portion of an insulating base to form a plurality of gate openings and a plurality of slits each communicating to adjacent gate openings; depositing a conductive material on the entire surface of the resulting base under such conditions that the slits are covered therewith but the gate openings are not completely covered therewith to form a conductive film on a top surface of the insulating base and to form an emitter electrode layer in the gate openings and the slits on the insulating base; depositing a sacrificial film material on the entire surface of the resulting base under such conditions that neither the gate openings nor the emitter electrode layer formed in the gate openings are covered therewith to form a sacrificial film on the conductive film; depositing an emitter tip material on the entire surface of the resulting base under such conditions that the gate openings are completely covered therewith to form emitter tips in the gate openings on the emitter electrode layer; removing the sacrificial film and the emitter tip material deposited on the sacrificial film; and etching the conductive film formed on the top surface of the insulating base into a desired configuration to form a gate electrode layer.

In accordance with an eighth aspect of the present invention, there is provided a process for fabricating an electron emitter array, comprising the steps of: etching a surface portion of an insulating base to form a plurality of gate openings which are circular and each have a diameter greater than a distance between centers of adjacent gate openings; depositing a conductive material on the entire surface of the resulting base under such conditions that the gate openings are not completely covered therewith to form a conductive film on a top surface of the insulating base and to form an emitter electrode layer in the gate openings on the insulating base; depositing a sacrificial film material on the entire surface of the resulting base under such conditions that neither the gate openings nor the emitter electrode layer formed in the gate openings are covered therewith to form a sacrificial film on the conductive film; depositing an emitter tip material on the entire surface of the resulting base under such conditions that the gate openings are completely covered therewith to form emitter tips in the gate openings on the emitter electrode layer; removing the sacrificial film and the emitter tip material deposited on the sacrificial film; and etching the conductive film formed on the top surface of the insulating base into a desired configuration to form a gate electrode layer.

BRIEF DESCRIPTION OF THE DRAWINGS

FIG. 12(*b*) is a schematic sectional view illustrating a short-circuited state of the electron emitter array of FIG. 12(*a*) in which a gate electrode layer and an emitter electrode layer are short-circuited;

FIG. 19(*b*) is a schematic sectional view illustrating a short-circuited state of the electron emitter array in which a gate electrode layer and an emitter electrode layer are short-circuited.

DETAILED DESCRIPTION OF THE PREFERRED EMBODIMENTS

Figure 1B:
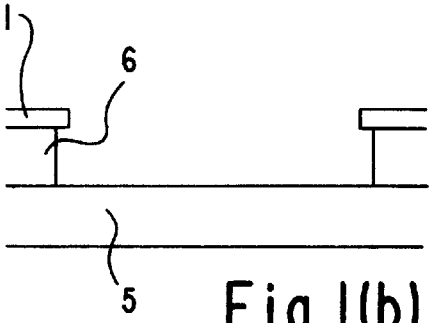
FIGS. 1(*a*) to 1(*d*), 2(*a*) to 2(*d*), 3(*a*) to 3(*d*) and 4(*a*) to 4(*d*) are diagrams for explaining respective steps of a fabrication process for an electron emitter array according to Example 1 of the present invention.
Figure 1C:
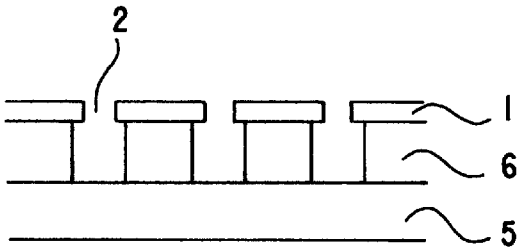
Figure 1D:
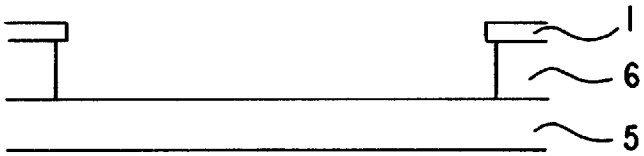
Figure 1A:
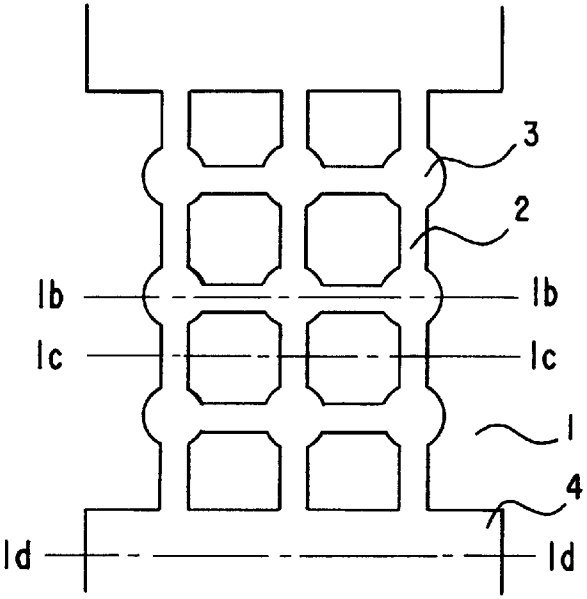
Figure 2B:
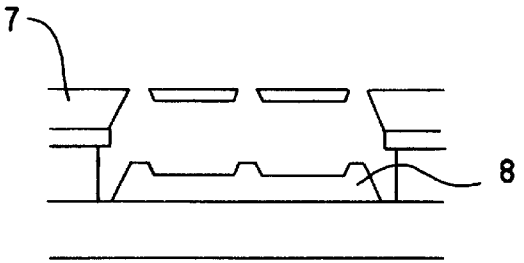
Figure 2C:
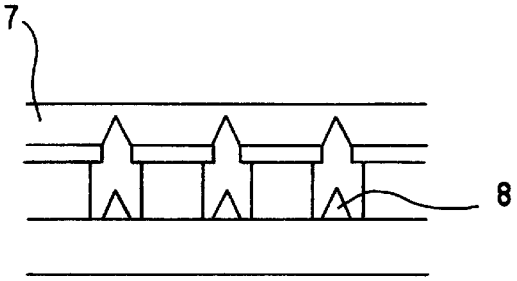
Figure 2D:
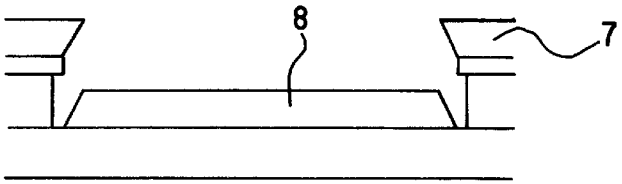
Figure 2A:
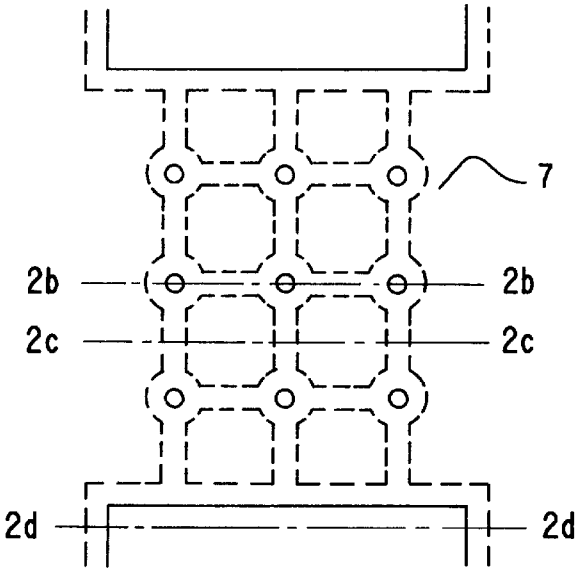
Figure 3B:
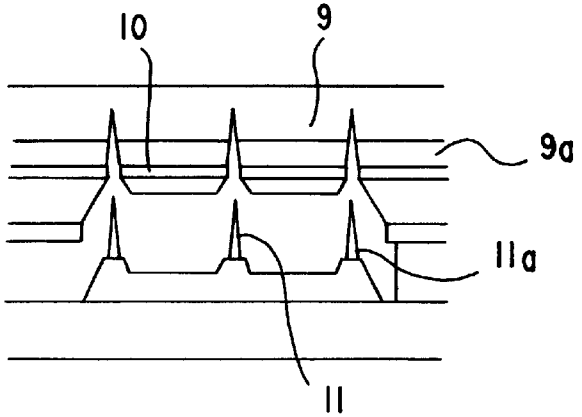
Figure 3C:
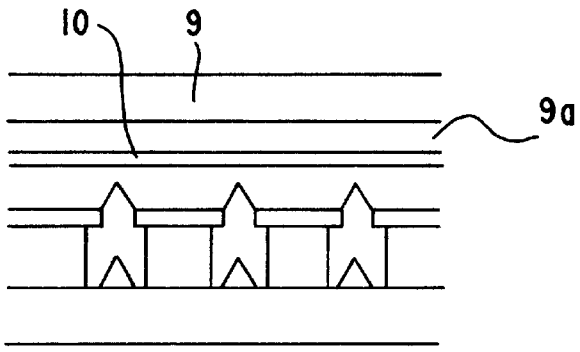
Figure 3D:
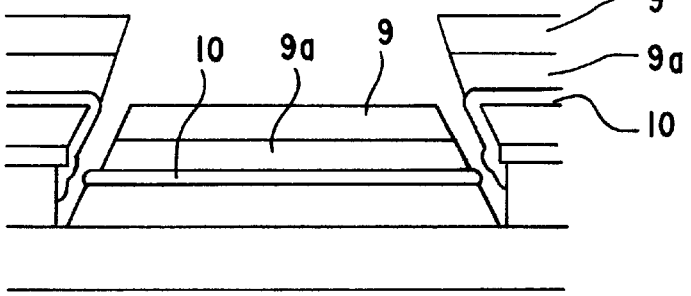
Figure 3A:
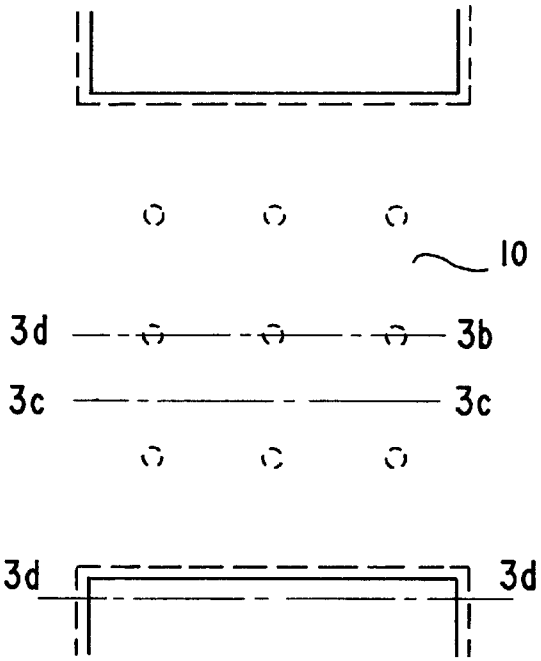
Figure 4B:
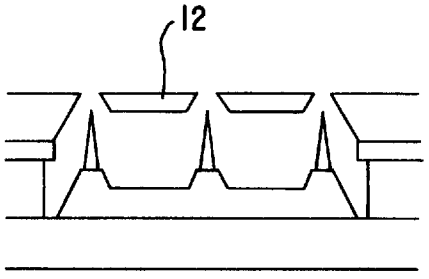
Figure 4C:
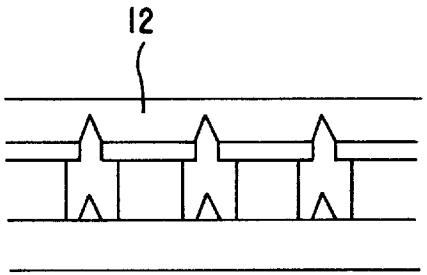
Figure 4D:
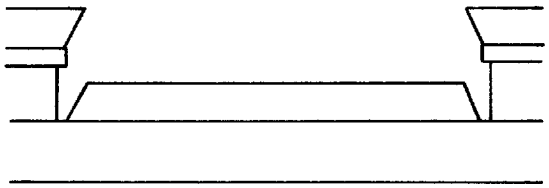
Figure 4A:
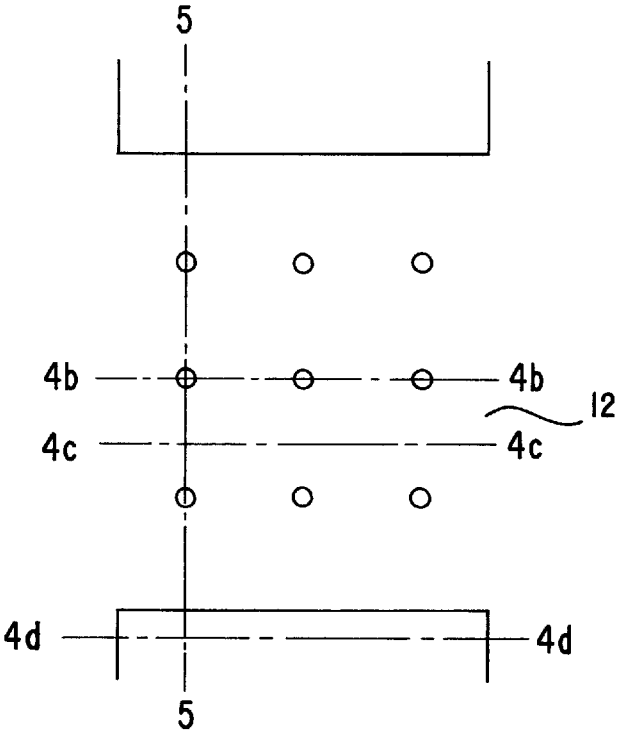
Figure 5:
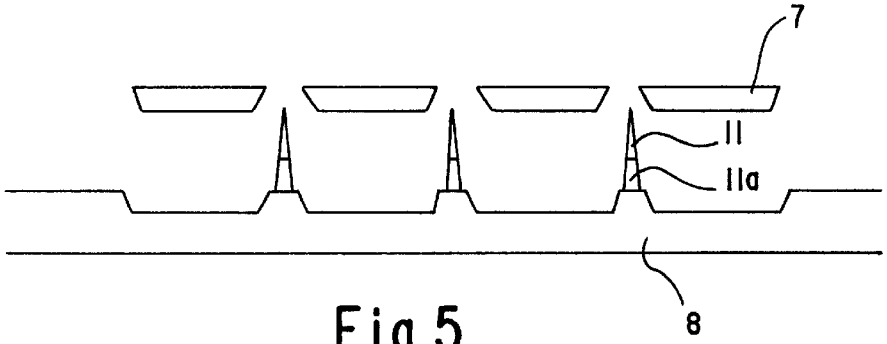
FIG. 5 is a sectional view taken along a line D—D' of FIG. 4(*a*)

The present invention will hereinafter be described. It is herein defined that the electron emitter element includes a single emitter tip and the electron emitter array includes a plurality of electron emitter elements.

The insulating base to be used in the present invention is a one-piece substrate or a composite of a substrate and an insulating film formed thereon. Usable as the one-piece substrate is an insulating substrate. Usable as the substrate of the composite the substrate and the insulating film are an insulating substrate and a conductive substrate. An exemplary insulating substrate is a glass substrate, and an exemplary conductive substrate is a silicon substrate.

A material to be used for the insulating film is not particularly limited, but examples thereof include silicon dioxide, silicon nitride, PSG and BPSG. The thickness of the insulating film depends on the material to be used, but is generally 0.5 $\mu$m to 2 $\mu$m. The formation of the insulating film is achieved by CVD or plasma CVD, for example.

A gate support film may be formed on the entire surface of the insulating base. By appropriately selecting a material for the gate support film, selectivity for the etching of the insulating base to be performed later can be controlled. The provision of the gate support film prevents the sacrificial film material, the conductive material and the like to be deposited in the subsequent steps from adhering onto a side wall of the gate opening. The material for the gate support film is not particularly limited, and may be either conductive or insulative. Examples of specific conductive materials include such metals as molybdenum, tungsten and titanium, and silicides such as of $MoSi_2$, $WSi_2$ and $TiSi_2$. Examples of specific insulative materials include silicon nitride and the like. The thickness of the gate support film depends on the material to be used, but may be 0.1 $\mu$m to 0.5 $\mu$m. The formation of the gate support film is achieved by sputtering or CVD, for example.

A mask to be used for etching for the formation of the slit and the gate opening is formed of a known mask material such as a photoresist on the gate support film or the insulating base. Where the insulating film is not provided, the gate support film and the insulating base are etched. Where the insulating film is provided, on the other hand, only the insulating film may be etched such that the substrate is exposed or is not exposed or, alternatively, both the insulating film and the substrate may be etched such that the substrate is exposed. Where the gate support film is provided, the gate support film is etched along with the insulating film. Among these etching methods, etching only the insulating film for exposure of the substrate is particularly preferred because the depths of the slit and the gate opening can be readily controlled. At this time, the insulating base is etched to a depth of 0.5 $\mu$m to 2 $\mu$m. Where the gate support film is present, an anisotropic etching technique such as RIE and an isotropic etching technique such as using a hydrofluoric acid solution are preferably used in combination. The anisotropic etching technique can well control the configurations of the slit and the gate opening. The sacrificial film material, the conductive material and the like to be deposited in the subsequent steps are prevented from adhering onto side walls of the slit and the gate opening by under-etching the insulating film or the insulating substrate below the gate support film by way of the isotropic etching technique.

The configuration of the slit is not particularly limited, but it is necessary that the width thereof is narrower than that of the gate opening. More specifically, the width ratio between the slit and the gate opening is preferably 1:2 to 1:4. The number of slits to be formed is not particularly limited as long as an electric current can be supplied to the emitter tip formed in the gate opening via an emitter electrode layer formed in at least one slit.

The configuration of the gate opening is not particularly limited, but may be a polygon such as triangle or rectangle, circle, oval or the like. In terms of the symmetry thereof, a circular configuration is preferred. Where the gate opening has the circular configuration, the diameter thereof is typically not greater than 3.0 $\mu$m, preferably 0.8 u to 1.5 $\mu$m in consideration of light exposure resolution for the formation of the gate opening and the integration degree of the electron emitter array.

After the mask is removed, the conductive material is deposited on the entire surface of the resulting base under such conditions that the slit is covered therewith and the gate opening is not completely covered therewith. At this time, the emitter electrode layer is formed in the slit and the gate opening on the insulating base, and the conductive film is formed on the top surface of the insulating base or the gate support film. The emitter electrode layer has a plan configuration compatible to the configurations of the slit and the gate opening, a triangular sectional configuration in the slit and a trapezoidal sectional configuration in the gate opening. Examples of specific conductive materials include such metals as molybdenum, tantalum, tungsten and titanium, and silicides of these metals. The deposition method is not particularly limited, but evaporation and the like can be employed.

In turn, the sacrificial film material is deposited on the entire surface of the resulting base under such conditions that neither the gate opening nor the emitter electrode layer formed in the gate opening is not covered therewith to form the sacrificial film on the conductive film. Examples of specific sacrificial film materials include magnesium compounds, among which magnesium oxide is preferred because removal of the sacrificial film is facilitated in the subsequent etching process. The thickness of the sacrificial film is not particularly limited, but is preferably 0.2 $\mu$m to 0.6 $\mu$m in consideration of the subsequent etching process. The deposition method is not particularly limited, but an oblique evaporation method using an evaporation angle of 10° to 30° may be employed. The oblique evaporation can prevent the sacrificial film material from covering the side walls and bottom of the gate opening.

Subsequently, the emitter tip material is deposited on the entire surface of the resulting base under such conditions that the gate opening is completely covered therewith. Thus, the emitter tip is formed in the gate opening on the emitter electrode layer. The height of the emitter tip is preferably 1 μm to 2 μm. Examples of specific emitter tip materials include such metals as nickel, platinum, gold, molybdenum, titanium, tantalum and tungsten, and silicides of these metals. The emitter tip may be of a double-layer structure such as having an upper layer of nickel, platinum or gold and a lower layer of molybdenum, titanium, tantalum or tungsten. The double-layer emitter tip has a sharp tip to generate a highly intensive electric field. The deposition of the emitter tip material is achieved by vacuum evaporation or sputtering, for example.

Before the deposition of the emitter tip material, a negative feedback layer may be formed between the emitter tip and the emitter electrode layer by depositing a high-resistance material such as silicon. The negative feedback layer serves to improve the uniformity of emitted electric current.

The emitter electrode layer in the slit may include a high-resistance layer. With this arrangement, even if a defect occurs due to a short circuit between the emitter electrode layer and the gate electrode layer, the defect can be limited within the short-circuited portion. Thus, the redundancy of the electron emitter element can be improved.

Next, the emitter tip material deposited on the sacrificial film is lifted off by removing the sacrificial film. The removal of the sacrificial film is preferably achieved by wet etching. Exemplary etchants to be used for the wet etching include acetic acid, phosphoric acid, boric acid and other known etchants which are capable of removing the sacrificial film. Where the sacrificial film is formed of a magnesium compound and the emitter tip is formed of a material including nickel, for example, an aqueous solution of acetic acid is preferably used.

Then, the conductive film on the top surface of the resulting base is etched into a desired configuration to form the gate electrode layer. The etching method is not particularly limited, but either a wet etching or a dry etching may be employed. Thus, the electron emitter element of the present invention is completed. The electron emitter array can be fabricated by forming a plurality of electron emitter elements in the aforesaid manner.

Although the foregoing explanation pertains to the electron emitter element and the electron emitter array having the slit, the provision of the slit can be dispensed with. More specifically, circular gate openings are provided, each having a diameter greater than a distance between centers of adjacent gate openings. Thus, an electron emitter array can be provided which has gate openings partially overlapped with each other.

The electron emitter array fabricated in the aforesaid manner can be used as a pixel in a flat panel display device. The number of electron emitter elements in one pixel is typically 200 to 4000. If the continuity between the respective electron emitter tips is established by the emitter electrode layer, it is not necessarily required to connect all the adjacent emitter tips via the emitter electrode layer. However, it is more preferable to connect all the adjacent emitter tips to each other via the emitter electrode layer, because the resistance of the emitter electrode layer can be reduced.

Alternatively, one pixel may be constituted by one or more blocks each having one or more electron emitter elements. In such a case, 4 to 100 blocks each having 4 to 100 electron emitter elements are preferably used to form one pixel.

A common power supply layer having a greater width than the emitter electrode layer formed in the slits may be formed between adjacent blocks. The common power supply layer is connected to the emitter electrode layer in the slits connected to the emitter tips. In an electron emitter array provided with the common power supply layer having a greater width, the interconnection resistance can be reduced in comparison with an electron emitter array not having the common power supply layer.

A thin line portion of the gate support film formed between each of the blocks and a portion surrounding the blocks may be partially cut off and/or narrowed. A lead electrode layer for connecting to a power supply layer for the gate electrode layer extends from the conductive film to overhang the cut-off portion of the gate support film. With this arrangement, the lead electrode layer functions as a kind of fuse for protection from a large current flowing when an emitter tip is broken or a short circuit occurs between the gate electrode layer and the emitter electrode layer due to dust or the like. The resistance of the fuse can be adjusted to a desired value by controlling the width of the lead electrode layer. The thin line portion of the gate support film may be under-etched for removal thereof after the formation of the gate electrode layer. The under-etching is achieved by wet etching, for example. A construction disclosed in Japanese Unexamined Patent Publication No. 5144370 (1993) may otherwise be employed to provide the electron emitter array with a fuse function.

The cathode plate according the present invention includes a plurality of electron emitter arrays of the aforesaid construction arranged in a matrix. The cathode plate can be used as an electron source for a flat panel display device, an image tube and the like. The number of the electron emitter arrays arranged in the matrix is not particularly limited, but may be determined depending on the size of a display area of a display device to be fabricated. A window may be provided between adjacent electron emitter arrays. Further, windows of adjacent electron emitter arrays to be connected to different emitter electrodes may be separated from each other by a window separating portion of the gate support film present therebetween. The separation of the windows makes it possible to isolate emitter electrodes of the adjacent electron emitter arrays in a self-alignment manner during the deposition of the conductive material. Further, adjacent gate electrodes can be isolated by destroying the window separating portion of the gate support film. The destruction of the window separating portion is achieved by applying an appropriate voltage to the gate electrode layers across the window separating portion. Thus, only one mask is required throughout the fabrication process for the cathode plate, which is used for the patterning of the gate support film.

The flat panel display device according to the present invention includes a cathode plate of the aforesaid construction, and an anode plate disposed over electron emitter arrays. The anode plate includes an electrode coated with a fluorescent substance and an insulating substrate. The fluorescent substance, the material for the electrode and the insulating substrate to be used are not particularly limited, but those known in the art can be used. The electrode may be a plain one formed on the entire surface of the insulating substrate or, alternatively, may be of a comb-like configuration. A plurality of fluorescent substances may be used for color display.

EXAMPLE

In the following examples, there will be described electron emitter arrays, a cathode plate and a flat panel display device each having a specific number of electron emitter elements. However, the number of the electron emitter elements is not limited to the specific number.

EXAMPLE 1

The process for fabricating an electron emitter array according to the present invention will be described in more detail with reference to FIGS. 1 to 8 in which nine electron emitter elements are arranged in a 3×3 matrix in one pixel. FIGS. 1(*a*), 2(*a*), 3(*a*) and 4(*a*) are plan views of the electron emitter array. FIGS. 1(*b*), 2(*b*), 3(*b*) and 4(*b*) are sectional views taken along lines A–A' of FIGS. 1(*a*), 2(*a*), 3(*a*) and 4(*a*), respectively. FIGS. 1(*c*), 2(*c*), 3(*c*) and 4(*c*) are sectional views taken along lines B–B' of FIGS. 1(*a*), 2(*a*), 3(*a*) and 4(*a*), respectively. FIGS. 1(*d*), 2(*d*), 3(*d*) and 4(*d*) are sectional views taken along lines C—C' of FIGS. 1(*a*), 2(*a*), 3(*a*) and 4(*a*), respectively. FIGS. 7(*a*) and 8(*a*) are plan views of the electron emitter array. FIGS. 7(*b*) and 8(*b*) are sectional views taken along lines C–C' of FIGS. 7(*a*) and 8(*a*), respectively.

An insulating film 6 of silicon dioxide having a thickness of 1.2 μm was formed on an insulating glass substrate 5 by a plasma CVD. A gate support film 1 of molybdenum silicide having a thickness of 0.1 μm was formed on the insulating film 6 by sputtering. A resist pattern (not shown) was formed on the gate support film 1 in such a configuration that gate openings were communicated to adjacent slits 2. The diameter of each of the gate openings 3 was 1.7 μm and the width of each of the slits was 0.6 μm. Further, the resist pattern includes openings for windows 4 which were to be formed between adjacent pixels to isolate gate electrode layers from each other in the subsequent step. The gate support film 1 and the insulating film 6 were successively etched for removal thereof by an RIE method using the aforesaid resist pattern as a mask. The insulating film 6 was selectively etched with a hydrofluoric acid solution to be undercut by 0.2 μm. (See FIGS. 1(*a*) to 1(*d*).)

Figure 6:
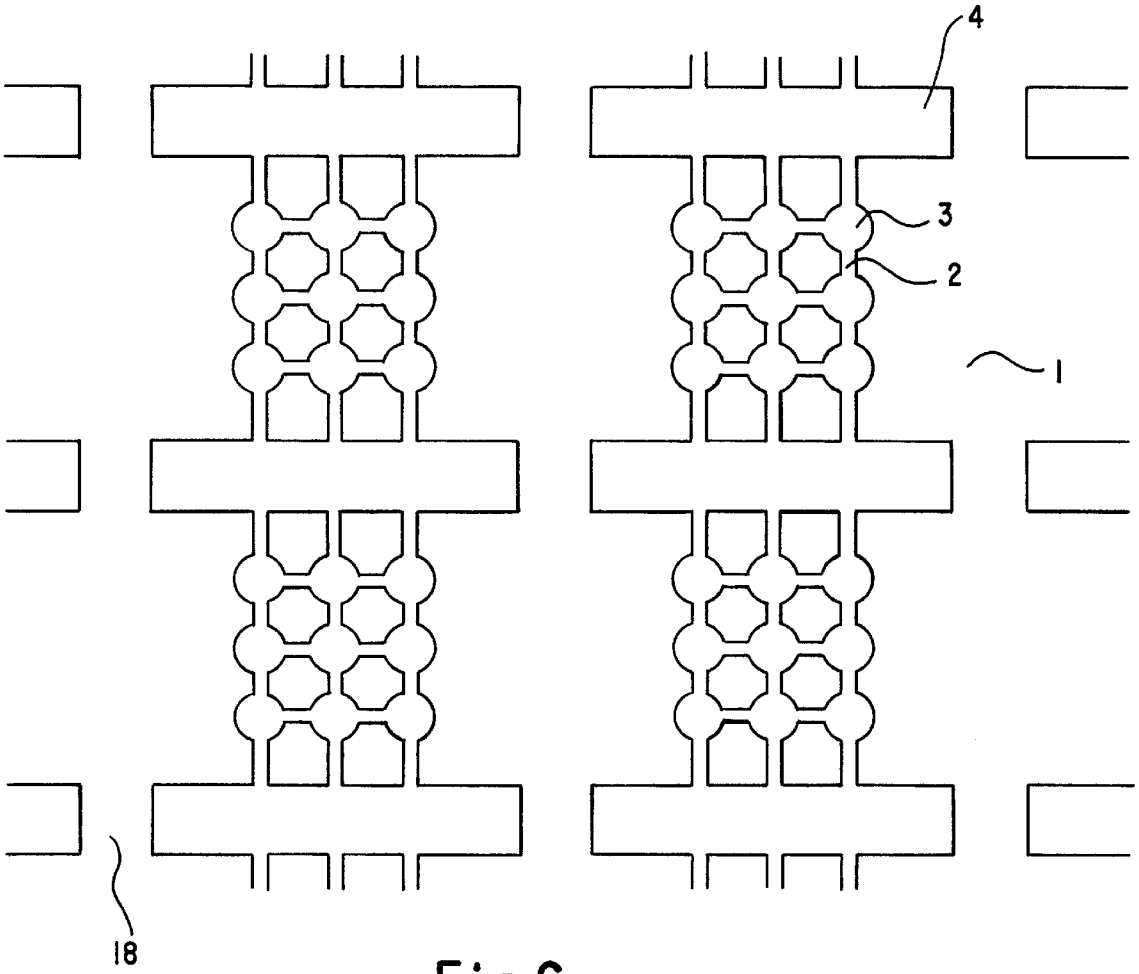
FIGS. 6, 7(*a*), 7(*b*), 8(*a*) and 8(*b*) are diagrams for explaining respective steps of the fabrication process for the electron emitter array according to Example 1 of the present invention.
Figure 7A:
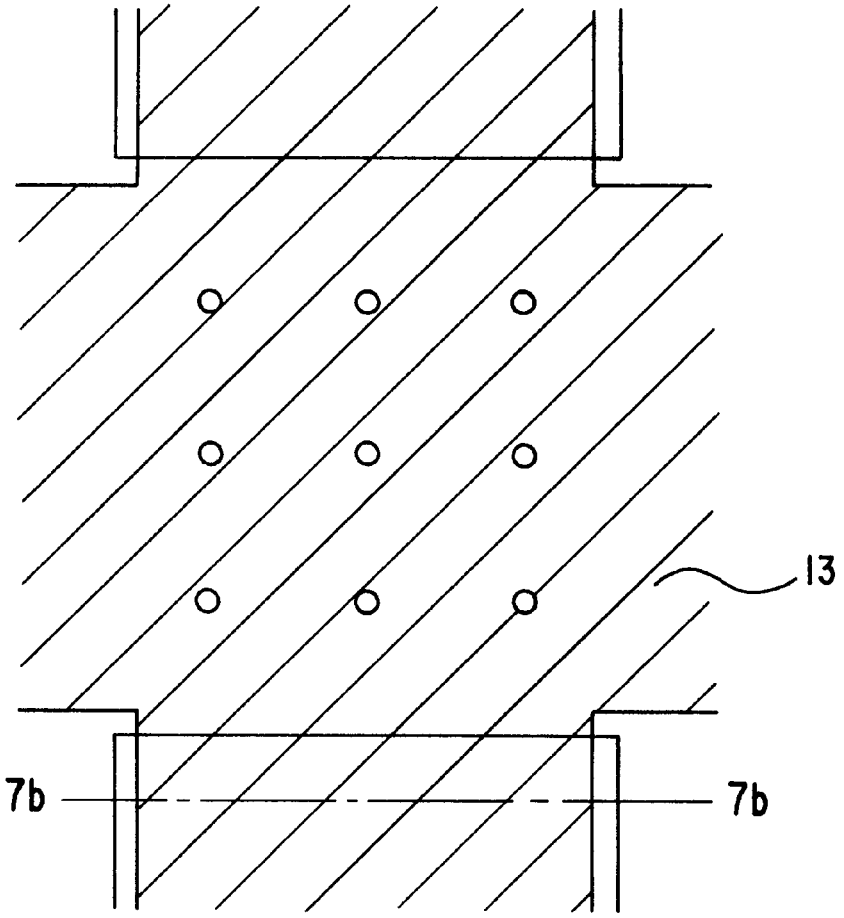
Figure 7B:
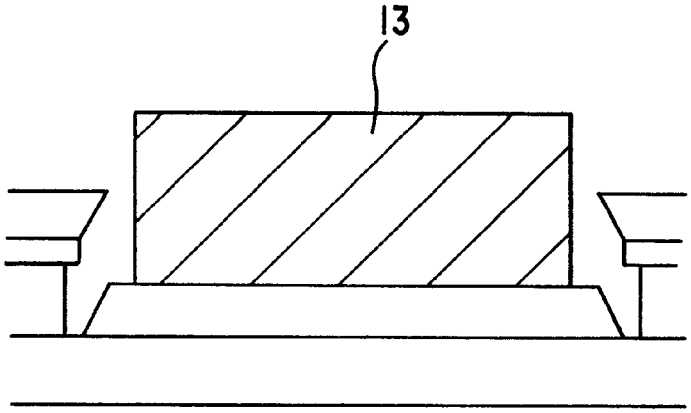
Figure 8A:
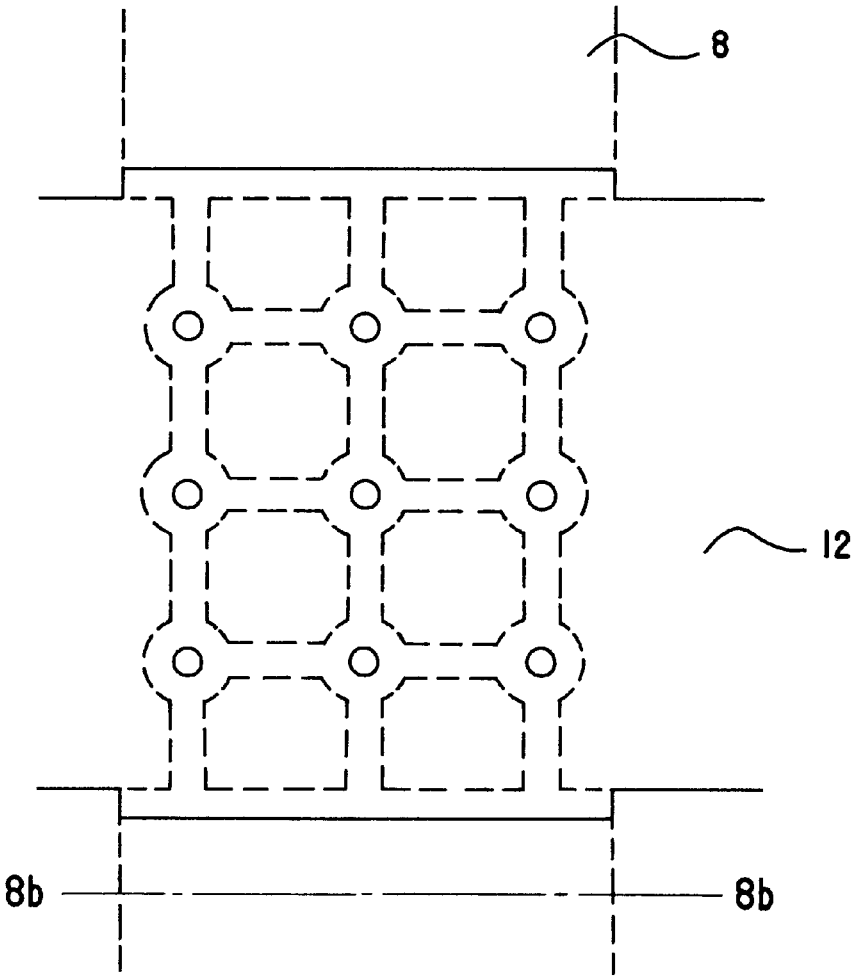
Figure 8B:
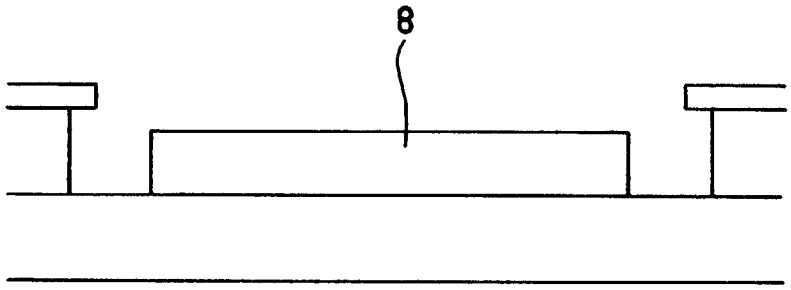

Although the fabrication of only one pixel (electron emitter array) is herein described with reference to FIGS. 1(*a*) to 1(*d*), a plurality of pixels (electron emitter arrays each including slits 2, gate openings 3 and windows 4) arranged in a matrix was fabricated as shown in FIG. 6. Adjacent windows 4 were separated by a portion 18 of the gate support film for emitter electrode isolation.

In turn, a conductive material of titanium was deposited on the entire surface of the resulting substrate at a deposition rate of 2 Å/sec by evaporation to form a conductive film 7 and an emitter electrode layer 8. The conductive material protruded from edges of the gate support film 1 as the deposition proceeded. Since the width of the slits 2 was smaller than the diameter of the gate openings 3, the slits 2 were completely covered with the conductive material when the material was deposited to a thickness of 0.6 μm. When the conductive material was deposited to a thickness of 0.91 μm, the deposition was stopped. At this time, the diameter of the gate openings 3 was reduced to 0.8 μm. (See FIGS. 2(*a*) to 2(*d*).) In FIG. 2(*a*), dotted lines indicate outlines of the slits 2, the gate openings 3 and the windows 4 before the deposition of the conductive material. Solid lines indicate outlines of the gate openings 3 and the windows 4 reduced by the formation of the conductive film 7.

In the aforesaid step, the emitter electrode layer 8 was formed in the slits 2, the gate openings 3 and the windows 4 on the insulating substrate 5. The emitter electrode layer 8 has a triangular sectional configuration in the slits 2, and a trapezoidal sectional configuration in the gate openings 3 and the windows 4. Since the emitter electrode layer 8 was isolated from an emitter electrode layer of an adjacent pixel by the portion 18 of the gate support film for emitter electrode layer isolation, the formation of the emitter electrode layer 8 was completed without any additional processing. The conductive material deposited on the gate support film 1 completely covered the slits 2 and, therefore, continuity of the conductive film 7 was established. The conductive film 7 was formed into a gate electrode layer in the subsequent step. (See FIGS. 2(*b*) and 2(*d*).)

In turn, a sacrificial film material of magnesium oxide was deposited to a thickness of 0.4 μm on the entire surface of the resulting substrate by an oblique evaporation to form a sacrificial film 10. A high-resistance negative feedback material 9*a* of silicon was deposited to a thickness of 0.5 μm on the entire surface of the resulting substrate. Then, an emitter tip material 9 of nickel was deposited to a thickness of 1.0 μm on the entire surface of the resulting substrate to completely cover the gate openings therewith (see FIGS. 3(*a*) to 3(*d*)). By the deposition of the negative feedback material 9*a* and the emitter tip material 9, negative feedback layers 11*a* and emitter tips 11 were formed in the gate openings 3 (see FIG. 3(*b*)). In FIG. 3(*a*), dotted lines correspond to portions indicated by the solid lines in FIG. 2(*a*), and solid lines indicate outlines of the windows 4 reduced by the deposition of the emitter tip material 9.

Subsequently, the sacrificial film 10 was dissolved with an acetic acid solution for removal (lift-off) of the negative feedback layer material 9*a* and the emitter tip material 9 on the gate support film 1, whereby the emitter tips 11 formed in the gate openings 3 on the emitter electrode layer 8 were exposed (see FIGS. 4(*a*) to 4(*d*)). FIG. is a sectional view taken along a line D–D' of FIG. 4(*a*).

Next, a resist 13 was deposited to cover the entire surface of the resulting substrate except the portion 18 of the gate support film for emitter electrode layer isolation (see FIGS. 7(*a*) and 7(*b*)).

Further, the portion 18 of the gate support film was etched by an RIE method using the resist 13 as a mask for removal thereof. Thus, the gate electrode layer 12 in a line shape was isolated from a gate electrode layer of an adjacent pixel (see FIGS. 8(*a*) and 8(*b*)). The gate electrode layer 12 cross the emitter electrode layer 8 formed therebelow without the insulating film 6 interposed therebetween. More specifically, the gate electrode layer 12 and the emitter electrode layer 8 are insulated from each other by gaps in the slits 2.

Thus, the electron emitter array was fabricated. With reference to Table 1, the fabrication process for an electron emitter array according to Example 1 will be compared with the conventional process.

TABLE 1

| Conventional fabrication process |
|---|
| (1) Deposition of emitter electrode layer material |
| (2) Formation of emitter electrode layer |
| (a) Application of photoresist |
| (b) Light exposure |
| (c) Etching |
| (d) Removal of photoresist |
| (3) Formation of insulating film |
| (4) Formation of conductive film |
| (5) Formation of gate openings |

TABLE 1-continued (a) Application of photoresist
(b) Liqht exposure
(c) Etching
(d) Removal of photoresist
(6) Under-etching of insulating film
(7) Oblique evaporation of sacrificial film
(8) Deposition of emitter tip material
(9) Formation of lift-off pattern
(a) Application of photoresist
(b) Light exposure
(c) Etching
(10) Lift-off
(11) Formation of gate electrode layer
(a) Application of photoresist
(b) Light exposure
(c) Etching
(d) removal of photoresist Fabrication process of present invention (1) Formation of insulating film
(2) Formation of gate support film
(3) Formation of gate openings
(a) Application of photoresist
(b) Light exposure
(c) Etching
(d) Removal of photoresist
(4) Under-etching of insulating film
(5) Deposition of conductive material (Formation of emitter electrode layer)
(6) Oblique evaporation of sacrificial film
(7) Deposition of emitter tip material
(8) Lift-off
(9) Formation of gate electrode layer
(a) Application of photoresist
(b) Light exposure
(c) Etching
(d) removal of photoresist As can be understood from Table 1, the fabrication process of the present invention includes a reduced number of steps in comparison with the conventional process, and employs only two light exposure steps each using a photoresist, thereby significantly reducing the process time.

EXAMPLE 2

Electron emitter array was successfully fabricated in substantially the same manner as in Example 1, except that a glass substrate not provided with the insulating film 6 was etched to a depth of 1.2 $\mu$m.

EXAMPLE 3

Figure 9:
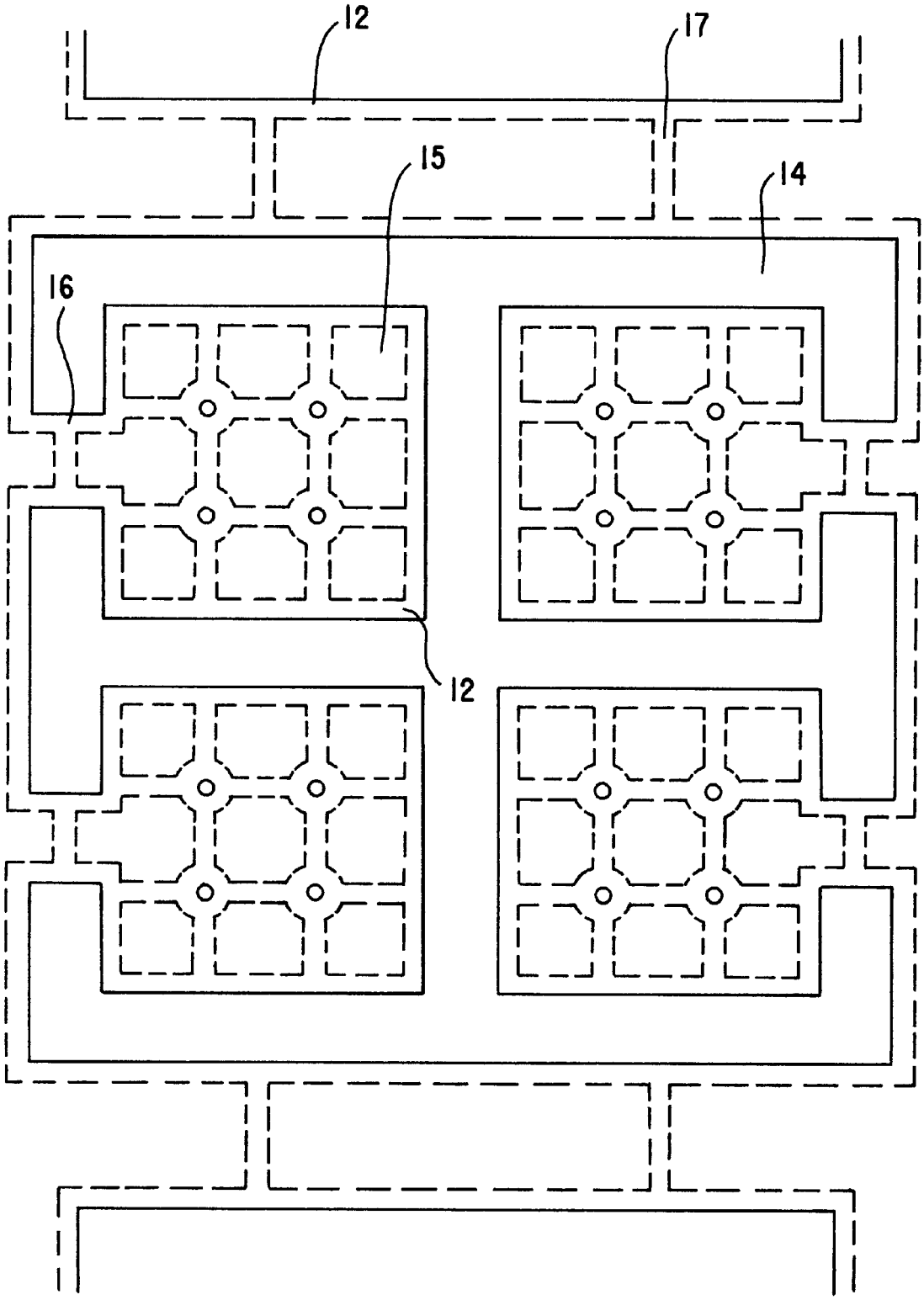
FIG. 9 is a schematic plan view illustrating an electron emitter array according to Example 3 of the present invention.

FIG. 9 is a plan view illustrating an electron emitter array in one pixel. In FIG. 9, dotted lines indicate outlines of openings of a gate support film. The electron emitter array was formed in substantially the same manner as in Example 1 except the following points.

As shown in FIG. 9, electron emitter elements in the array were divided into four blocks 15 each having four electron emitter elements, and a power supply layer 14 of the same material as the emitter electrode layer was formed in a region surrounded by the gate electrode layer 12. Since the power supply layer 14 was connected to the emitter electrode layer connected to the respective emitter tips (not shown), interconnection resistance in the pixel was reduced in comparison with the electron emitter array of Example 1.

As shown in FIG. 9, a narrow gate electrode portion connecting a lead electrode portion and each of plain gate electrode portions formed over the respective blocks 15 functioned as a fuse 16. The fuses 16 protruded from the gate electrode layer 12, thereby overhanging. The fuses 16 were formed in desired portions by cutting off parts of the gate support film and then forming a conductive film thereover for the formation of the gate electrode layer 12.

With this arrangement, the fuse 16 provides for the protection from a large current flowing when a short circuit between the gate electrode layer and the emitter electrode layer occurs due to breakage of an emitter tip or dust. Since the elect ron emitter array is generally used in a vacuum, vacuum insulation reduces the pre-arcing current of the fuse.

Since a wide spacing was provided between adjacent blocks 15, a relatively large area of the sacrificial film was exposed after the deposition of the emitter tip material. Thus, the lift-off process was facilitated in comparison with Example 1.

The electron emitter array in the pixel shown in FIG. 9 was electrically connected to an electron emitter array in an adjacent pixel via the emitter electrode layer (power supply layer) formed in slits 17 during the deposition of the conductive material.

EXAMPLE 4

Figure 10:
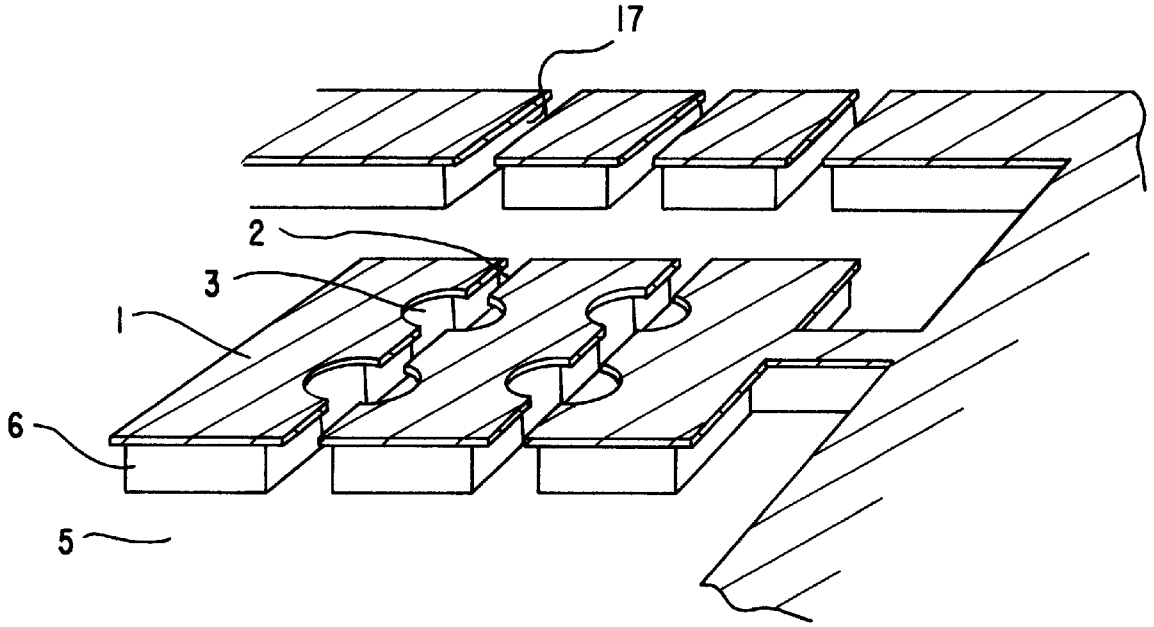
FIG. 10 is a perspective view for explaining a step of a fabrication process for an electron emitter array according to Example 4 of the present invention.

FIG. 10 is a perspective view illustrating one block of an incomplete electron emitter array in a pixel in which slits 2 and gate openings 3 are formed before the deposition of the conductive material. The electron emitter array was formed in substantially the same manner as in Example 1 except the following points. As shown, the gate openings 3 were joined to the slits 2, and the insulating film 6 was under-etched. A portion of the gate support film 1 for pixel isolation was provided with slits 17. Power supply layers of the emitter electrode layer for electrically connecting the pixel to an adjacent pixel were formed in the slits 17 on the substrate 5 during the deposition of the conductive material. As shown in FIG. 10, the gate openings 3 were joined to a smaller number of slits 2 than in Example 1. Even with this arrangement, the electrical connection between the emitter tips formed in the respective gate openings was suitably established by the emitter electrode layer formed in the step of depositing the conductive material.

EXAMPLE 5

Figure 11:
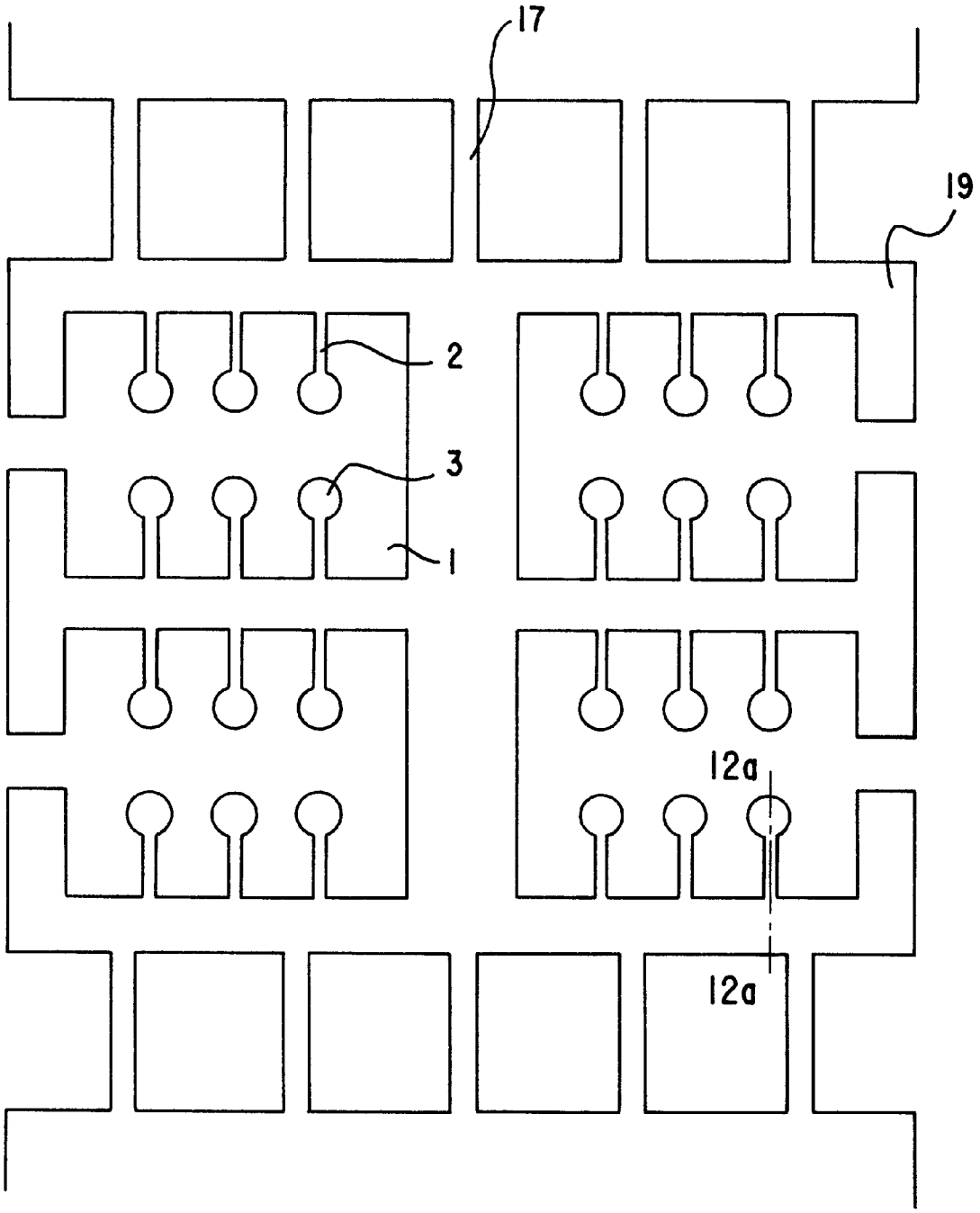
FIG. 11 is a diagram for explaining a step of a fabrication process for an electron emitter array according to Example 5 of the present invention.

FIG. 11 is a plan view illustrating an incomplete electron emitter array in which slits 2 and 17, gate openings 3 and opening 19 for power supply layer formation are formed in a gate support film 1. In Example 5, the slits 2 each had a width of 0.5 $\mu$m, and the slits 17 each had a width of 0.9 $\mu$m and a length of 3 $\mu$m. By using the gate support film 1, the electron emitter array was fabricated in substantially the same manner as in Example 1 except the following points. A high-resistance material of silicon was deposited to a thickness of about 0.7 $\mu$m until the slits 2 were completely covered, and then a conductive material of titanium was deposited to a thickness of 0.4 $\mu$m.

In Example 5, the emitter electrode layer was formed of the high-resistance material alone in the slits 2. The resistance of the emitter electrode layer was about 2Gn. The electron emitter array according to Example 5 was equivalent to that constructed such that the respective emitter tips thereof were supplied with power via resistors. With this construction, excessive current emission was appropriately controlled, and the emitter tips had more uniform electron emission characteristics.

Figure 19A:
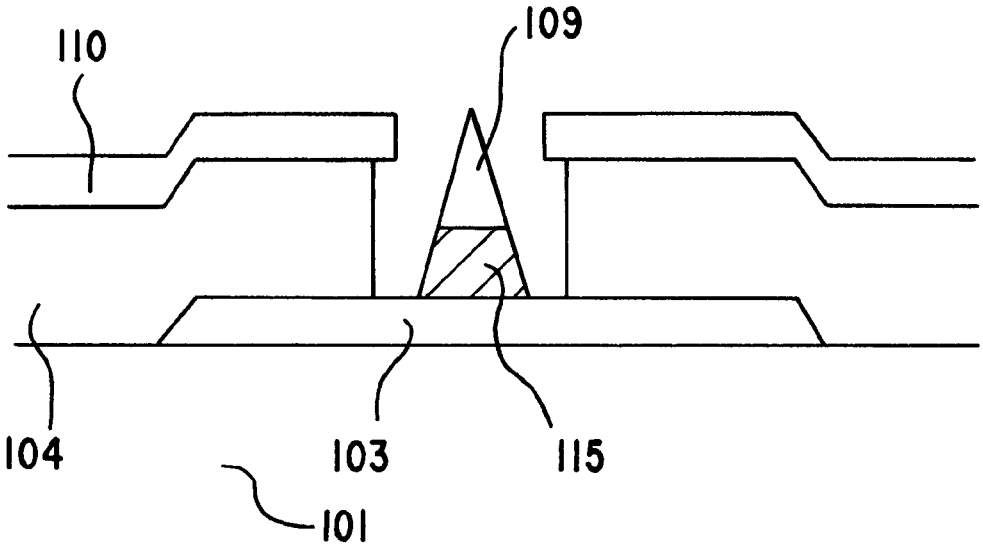
FIG. 19(*a*) is a schematic sectional view illustrating part of of the conventional electron emitter array.
Figure 19B:
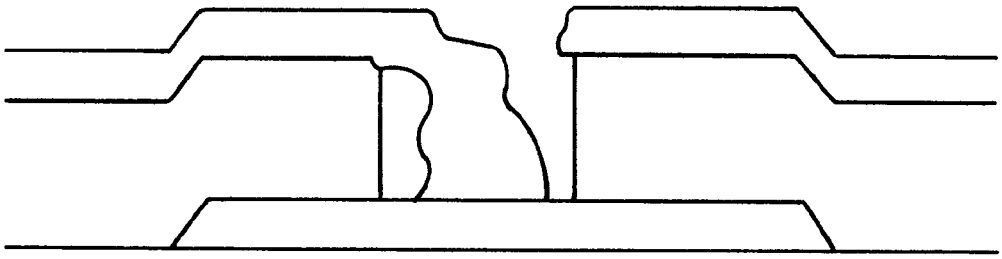

The conventional electron emitter array shown in FIG. 19(*a*) suffers from a short circuit between the emitter electrode line 103 and the gate electrode line 110 when arc discharge occurring during the operation of the electron emitter array destroys the emitter tip 109 of the double-layer structure along with the high-resistance layer 115 (see FIG. 19(*b*)).

Figure 12A:
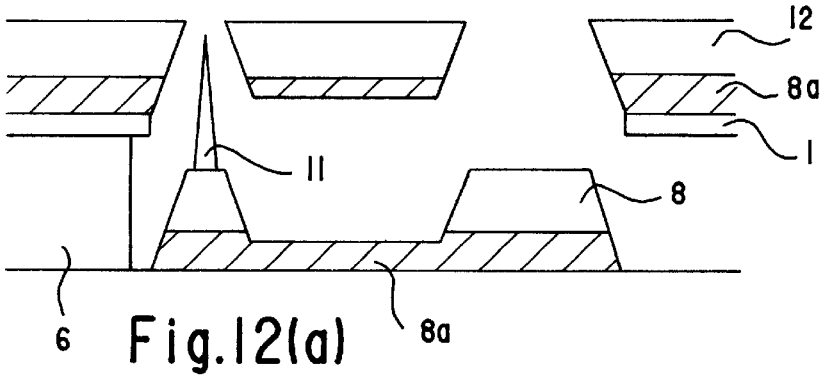
FIG. 12(*a*) is a schematic sectional view illustrating part of an electron emitter array according to Example 5 of the present invention.
Figure 12B:
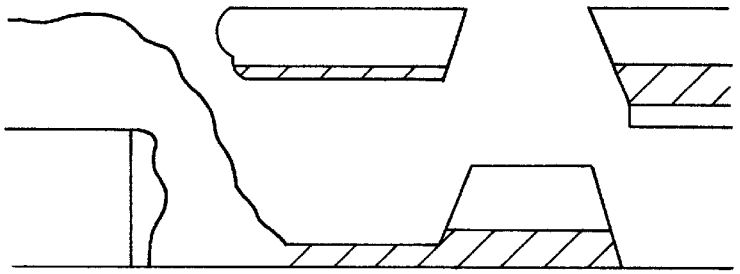

In the electron emitter array of Example 5 shown in FIG. 12(*a*), on the contrary, the emitter tip 11 was connected to the emitter electrode layer 8 via the high-resistance layer 8*a* even after the emitter tip 11 was broken. Therefore, the breakage of the emitter tip 11 did not entail a short circuit as shown in FIG. 12(*b*), so that the redundancy of the electron emitter array was improved. Note that FIG. 12(*a*) is a sectional view taken along a line E–E' of FIG. 11 after the electron emitter array is completed.

The high-resistance layer and the emitter electrode layer were formed in a double-layer structure in the gate openings 3, the openings 19 for power supply layer formation and the slits 17. Therefore, the interconnection resistance did not increase.

EXAMPLE 6

Figure 13:
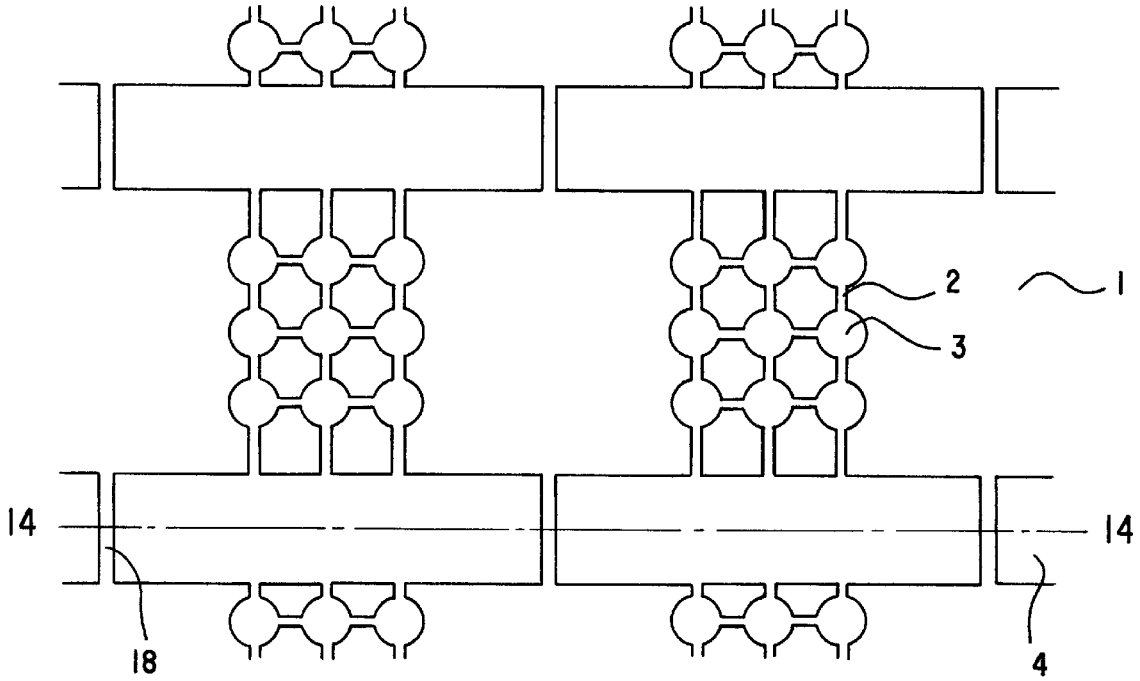
FIGS. 13 and 14 are diagrams for explaining a step of a fabrication process for an electron emitter array according to Example 6 of the present invention.

FIG. 13 is a plan view for explaining a step of a fabrication process for a cathode plate in which a plurality of pixels each including one electron emitter array are arranged in a matrix. In Example 6, electron emitter arrays were fabricated in substantially the same manner as in Example 1, except that the windows 4 were formed such that the portions 18 of the gate support film (narrower than those shown in FIG. 6) for emitter electrode layer isolation were provided between adjacent windows 4 as shown in FIG. 13.

Figure 14:
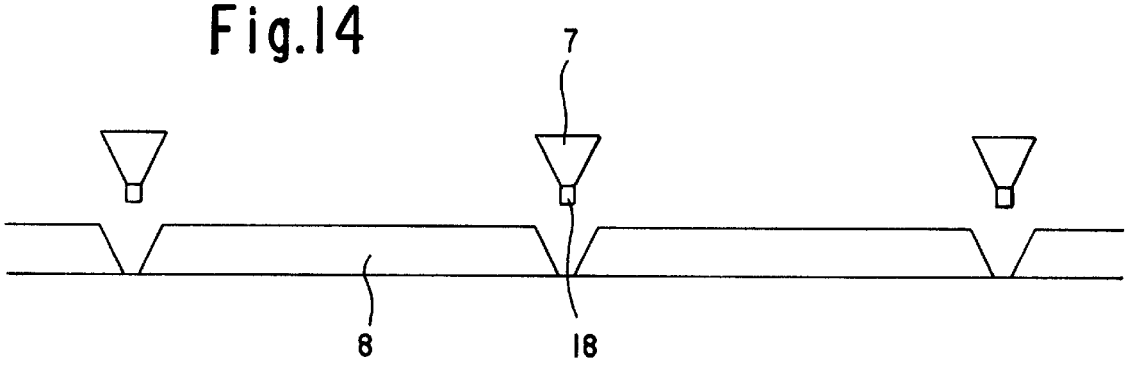

The portions 18 of the gate support film for emitter electrode layer isolation each served as a shade and allowed emitter electrodes 8 of adjacent pixels to be separated from each other in a self-alignment manner (see FIG. 14 which is a sectional view of the electron emitter arrays after the deposition of the conductive material, taken along a line F–F' of FIG. 13). After the deposition of the emitter tip material (corresponding to the step shown in FIG. 4), the portions 18 of the gate support film were fused by applying a voltage to adjacent gate electrodes across the portions 18. Thus, the adjacent gate electrodes were isolated from each other and, at the same time, adjacent pixels were isolated from each other.

The fabrication process of Example 6 can dispense with the patterning step for the formation of the gate electrode layers and therefore requires only one mask for light exposure throughout the fabrication process.

EXAMPLE 7

Figure 15:
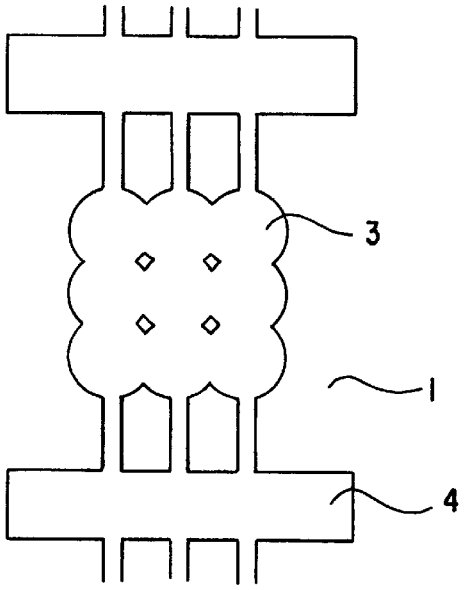
FIG. 15 is a diagram for explaining a step of a fabrication process for an electron emitter array according to Example 7 of the present invention.

An electron emitter array as shown in FIG. 15 was fabricated which included gate openings 3 each having a diameter which is greater than a distance between adjacent gate openings 3. Therefore, the gate openings 3 were partially overlapped with each other as shown in FIG. 15. The electron emitter array of FIG. 15 included emitter tips more densely integrated therein than the electron emitter array of Example 1, requiring a smaller voltage for providing a predetermined emission current.

EXAMPLE 8

Figure 16:
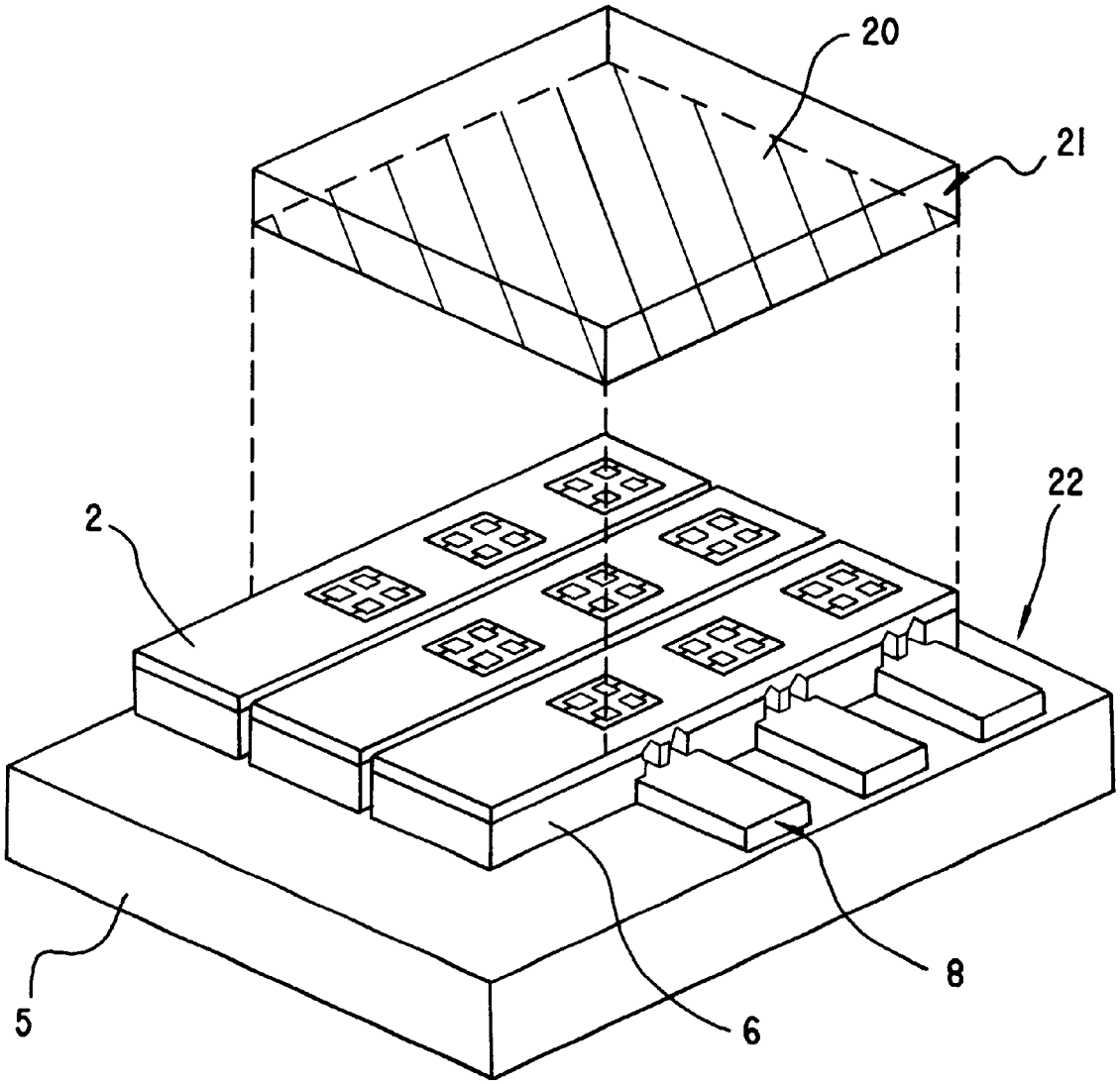
FIG. 16 is a schematic perspective view illustrating a flat panel display device according to Example 8 of the present invention.
Figure 17:
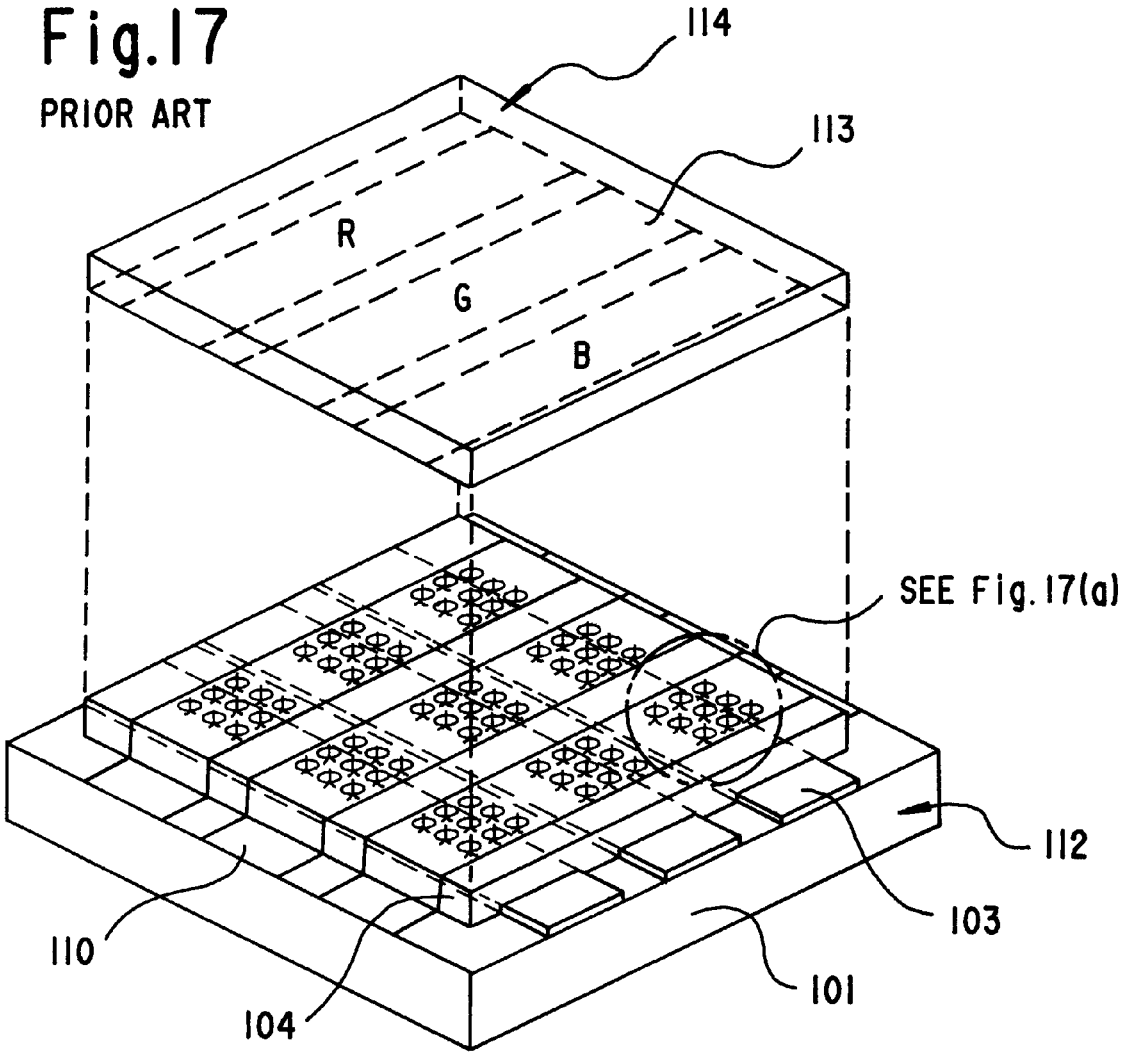
Fig.17 PRIOR ART
FIGS. 17 and 17*a* are schematic perspective views illustrating a conventional flat panel display device.
Figure 17A:
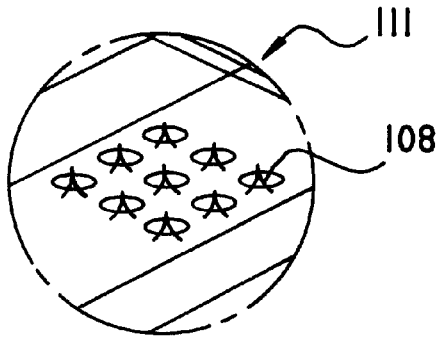
Figure 18A:
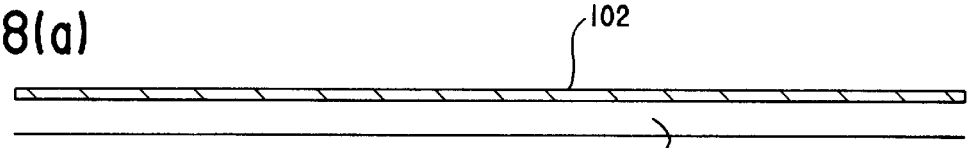
Fig.18(a) PRIOR ART
FIGS. 18*a* through 18*h* are schematic views for explaining respective steps of a fabrication process for a conventional electron emitter array.
Figure 18B:
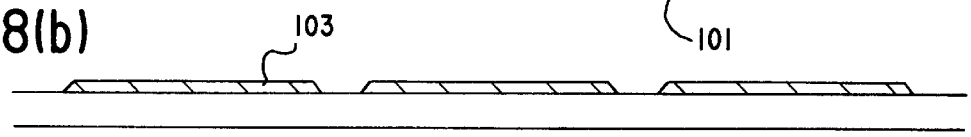
Fig.18(b) PRIOR ART
Figure 18C:
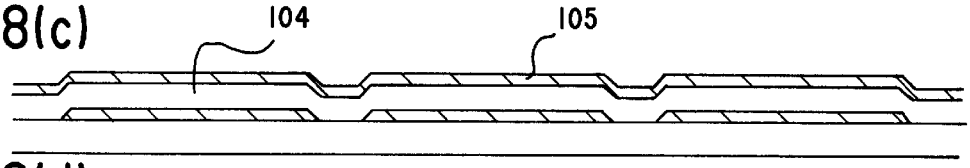
Fig.18(c) PRIOR ART
Figure 18D:
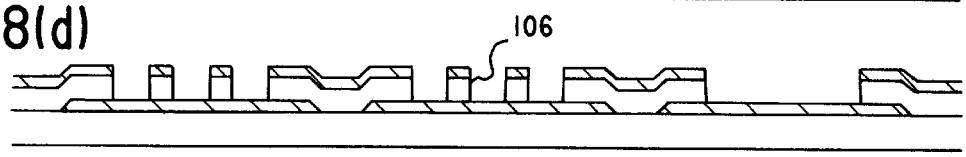
Fig.18(d) PRIOR ART
Figure 18E:
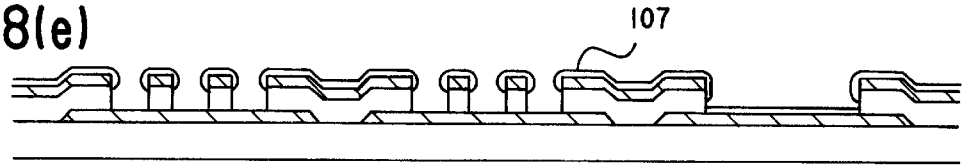
Fig.18(e) PRIOR ART
Figure 18F:
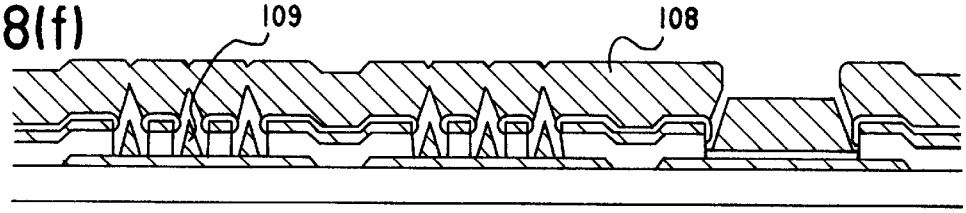
Fig.18(f) PRIOR ART
Figure 18G:
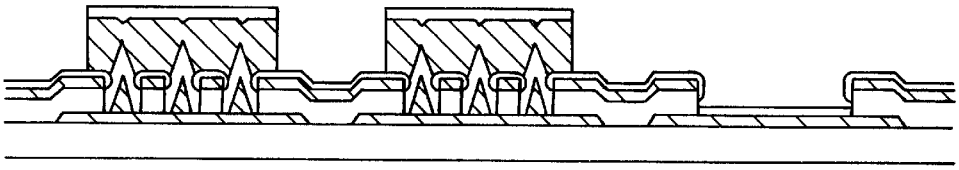
Fig.18(g) PRIOR ART
Figure 18H:
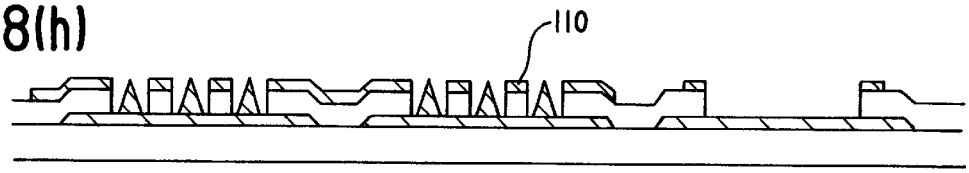
Fig.18(h) PRIOR ART

A cathode plate 22 was fabricated by arranging electron emitter arrays as shown in FIG. 9 in a matrix. An anode plate 21 having an electrode (not shown) coated with a fluorescent substance 20 was placed on the cathode plate 22 with spacers (not shown) interspersed therebetween. Then, the periphery of the combined anode and cathode plates was sealed with a frit, and the resulting panel was degassed by vacuum. Thus, a flat panel display device as shown in FIG. 16 was completed.

For color display, the electrode may be coated with fluorescent substances exhibiting red, green and blue which are arranged in an RGB repeat order. Further, the electron emitter elements or the electron emitter arrays of the present invention may be equidistantly arranged for integration thereof for fabrication of a flat panel display device.

In the electron emitter element and the electron emitter array according to the present invention, the emitter electrode layer and the gate electrode layer are isolated without an insulating film provided therebetween. Therefore, a short circuit will not occur between the emitter electrode layer and the gate electrode layer due to a pin-hole in the insulating film. In addition, the electrostatic capacitance between the emitter electrode layer and the gate electrode layer can be reduced. Therefore, the cathode plate including such electron emitter elements and electron emitter arrays arranged in a matrix requires a lower power for the driving thereof and offers an improved response speed.

The electron emitter element and the electron emitter array require a reduced voltage for extracting electrons, since the diameter of each of the gate openings thereof is reduced by the overhang of the conductive film so that an electric field can be highly intensified at a tip portion of each emitter tip.

In the process for fabricating an electron emitter array according to the present invention, the formation of the emitter electrode layer can be achieved by a single step of depositing a conductive material. Therefore, the steps of forming and etching a resist pattern after the formation of the emitter electrode layer can be eliminated which are required in the conventional fabrication process. Further, the openings can be formed in the insulating substrate by the etching thereof and, therefore, the step of forming an insulating film can also be dispensed with. Since a multiplicity of openings are formed on the insulating base, an exposed area of the sacrificial film is increased. Therefore, the sacrificial film can be lifted off without removing part of the emitter tip material. That is, the step of patterning the emitter tip material prior to the lift-off can be dispensed with.

Further, adjacent gate electrodes can be isolated from each other by destroying the window separating portion of the gate support film (or the portion of the gate support film for emitter electrode layer isolation). The destruction of the window separating portion is achieved by applying a voltage to the emitter tip material across the window separating portion. Therefore, the step of patterning the gate electrode layers can be dispensed with, and the fabrication process requires only one mask for light exposure.

Thus, the number of process steps can be reduced, thereby improving the yield of the electron emitter arrays and reducing the fabrication cost.

What is claimed is:

1. An electron emitter element comprising:

an insulating base having a gate opening and a slit communicating to the gate opening;

an emitter electrode layer formed on a first surface of the insulating base in the gate opening and the slit thereof;

an emitter tip formed in the gate opening on the emitter electrode layer;

a gate electrode layer formed on a second, top surface of the insulating base, covering the slit and circumscribing the gate opening and extending parallel to the first surface;

wherein the gate electrode layer and the emitter electrode layer are opposed to each other with a gap therebetween.

2. An electron emitter array which comprises a plurality of electron emitter elements, each electron emitter element of said plurality of electron emitter elements comprising:

an insulating base having a gate opening and a slit communicating to the gate opening;

an emitter electrode layer formed in the gate opening and the slit on the insulating base;

an emitter tip formed on a first surface of the insulating base in the gate opening on the emitter electrode layer;

a gate electrode layer formed on a second top surface of the insulating base, covering the slit and circumscribing the gate opening and extending parallel to the first surface;

wherein the gate electrode layer and the emitter electrode layer are opposed to each other and separated by a gap, wherein the emitter electrode layers of the respective electron emitter elements are electrically connected to each other, and wherein the gate electrode layers of the respective electron emitter elements are electrically connected to each other.

3. An electron emitter array as set forth in claim 2, wherein each two adjacent gate openings in the plurality of the electron emitter elements are connected by said slit, and an emitter electrode layer formed in said one slit is connected to emitter electrode layers formed in the adjacent gate openings.

4. An electron emitter array as set forth in claim 2, wherein the electron emitter array is divided into blocks each having a plurality of electron emitter elements, and a plain gate electrode formed in each of the blocks is connected to a power supply layer via a lead electrode, said power supply layer supplying power to said plain gate electrode and the emitter electrode layer formed in each of the blocks is connected to a common power supply layer to be used in common by the respective blocks, said common power supply layer supplying power to the emitter electrode layer.

5. An electron emitter array as set forth in claim 4, wherein, when a short circuit occurs in one of the blocks, the lead electrode corresponding to said one block fuses by an overcurrent generated due to the short circuit.

6. An electron emitter array as set forth in claim 2, wherein the emitter electrode layer formed in the slit includes a high-resistance layer thereupon.

7. An electron emitter array comprising:

a plurality of electron emitter elements arranged in an array and each having an insulating base having a gate opening, an emitter electrode layer formed on a first surface of the insulating base in the gate opening on the insulating base, an emitter tip formed in the gate opening on the emitter electrode layer, and a gate electrode layer formed on a second top surface of the insulating base as circumscribing the gate opening and extending parallel to the first surface, the gate electrode layer and the emitter electrode layer being separated by a gap;

the gate opening being circular and having a diameter greater than a distance between centers of gate openings of adjacent electron emitter elements.

8. A cathode plate comprising a plurality of electron emitter arrays as recited in claim 2 which are arranged in a matrix or integrated therein.

9. A cathode plate comprising a plurality of electron emitter elements as recited in claim 1 which are integrated therein.

10. A flat panel display device comprising:

a cathode plate as recited in claim 8; and an anode plate disposed facing opposite the cathode plate and having an electrode coated with a fluorescent substance which receives an electron emitted from an emitter tip of the cathode plate to illuminate.

11. A flat panel display device as set forth in claim 10, wherein the electrode of the anode plate is coated with three fluorescent substances respectively exhibiting different color lights in a predetermined repeat order.

12. An electron emitter element according to claim 1, wherein said insulating base comprises a one-piece substrate.

13. An electron emitter element as recited in claim 12, wherein said one-piece substrate comprises an insulating film formed thereupon.

* * * * *